United States Patent [19]

Schuster

[11] Patent Number: 4,597,523

[45] Date of Patent: Jul. 1, 1986

[54] CARRIER LOCK

[75] Inventor: Richard L. Schuster, Monroe, La.

[73] Assignee: Manville Service Corporation, Denver, Colo.

[21] Appl. No.: 620,307

[22] Filed: Jun. 13, 1984

[51] Int. Cl.[4] ..... B65D 65/06

[52] U.S. Cl. ..... 229/40; 206/140; 206/427

[58] Field of Search ..... 229/40, 48 R; 206/427, 206/434, 140

[56] References Cited

U.S. PATENT DOCUMENTS

| | | | |
|---|---|---|---|
| 3,294,280 | 12/1966 | Graser | 229/40 X |
| 3,398,856 | 8/1968 | Graser | 229/40 X |
| 3,478,951 | 11/1969 | Graser | 229/40 |
| 3,674,137 | 7/1972 | Graser | 229/40 X |
| 4,155,449 | 5/1979 | Bryne | 206/427 |
| 4,437,606 | 3/1984 | Graser | 206/140 X |

*Primary Examiner*—William Price
*Assistant Examiner*—Gary E. Elkins
*Attorney, Agent, or Firm*—John D. Lister; Cornelius P. Quinn

[57] ABSTRACT

A wrap-around style beverage package and production blank having new and improved locking features. The novel locking features comprise primary adjustable locking means, secondary punch-style locking means and tertiary locking means located on the overlapping margins of the package.

6 Claims, 7 Drawing Figures

12
14
16
18
20
22
24
26
30
32
34
36
38
40
42
44
46
48
50
52
54
56
58
60
62
64
66
68
70
72
74
76
78
80
82
84
86
88
90
92
94
96
98
100
102
104
106
108
110
112
114
116
118
120
122
124
126
128

CARRIER LOCK

BACKGROUND OF THE INVENTION

This invention relates to wrap-around style beverage carriers and more particularly to a new wrap-around style beverage package and production blank having new locking features.

Wrap-around style beverage carriers having bottom locking panels for locking the carrier tightly around the bottles contained in the package are known. Wrap-around style beverage carriers having adjustable locking features in the bottom panels of the carriers in order to lock the carrier tightly about oversized or undersized bottles are also known. Such locking features are generally shown in U.S. Pat. No. 3,395,791 issued to E. J. Graser on Aug. 6, 1968; U.S. Pat. No. 3,548,566 issued to E. C. Sherman on Dec. 22, 1970; and U.S. Pat. No. 3,478,951 issued to E. J. Graser on Nov. 18, 1969.

Punch style locking features on wrap-around style beverage carriers are also known such in U.S. Pat. No. 3,508,699 issued to E. J. Graser on Apr. 28, 1970. Recently, a new carrier with improved locking features that utilized both adjustable primary locks, secondary punch-style locks and tertiary punch-style locks to provide a better package has been marketed. U.S. Pat. No. 4,437,606 issued to E. J. Graser on Mar. 20, 1984 discloses this type of carrier.

SUMMARY OF THE INVENTION

The present invention is directed to a carrier which utilizes primary adjustable locks and secondary punch style locks. However, the tertiary or outboard locks employed in this invention comprise locking tabs on one bottom panel margin which are engaged in cutouts or openings on the other bottom panel margin to complete the locking of the carrier about the bottles or cans in the package. The spacing of the tab engaging edges of tertiary locking cutouts or openings relative to the free edge of the bottom margin is intermediate the spacing of the tab engaging edges of the oversized and undersized position primary locking slots to the free edge of the margin to provide a secure lock. The type of tertiary locking features employed, tab and cutout on opening, facilitates the locking process as the package is locked about the bottles or cans to be packaged with the primary and tertiary locks being engaged by the same locking operation.

DETAILED DESCRIPTION OF THE DRAWINGS

Figure 1:
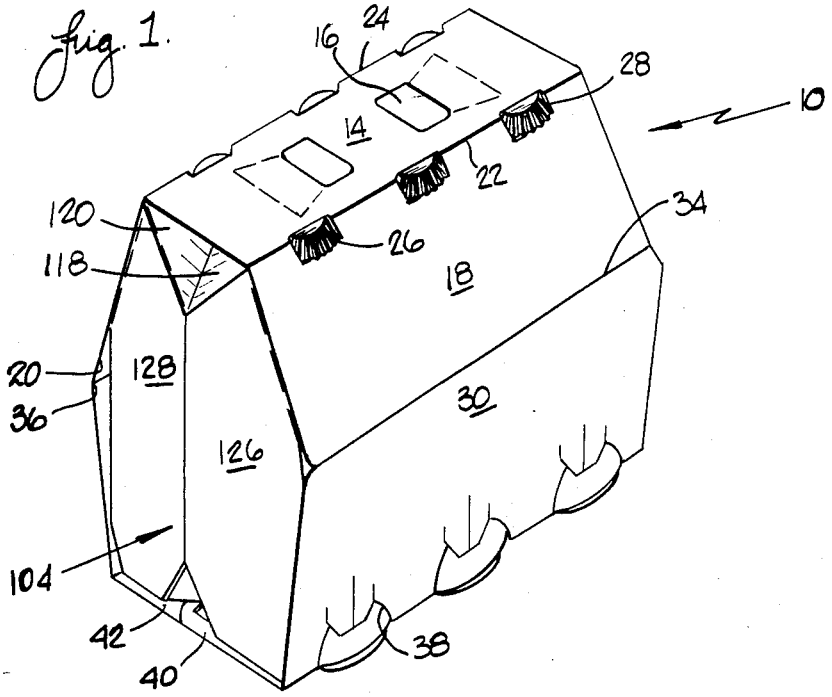
FIG. 1 is a perspective view of a typical bottle carrier employing the locking features of the present invention.
Figure 2:
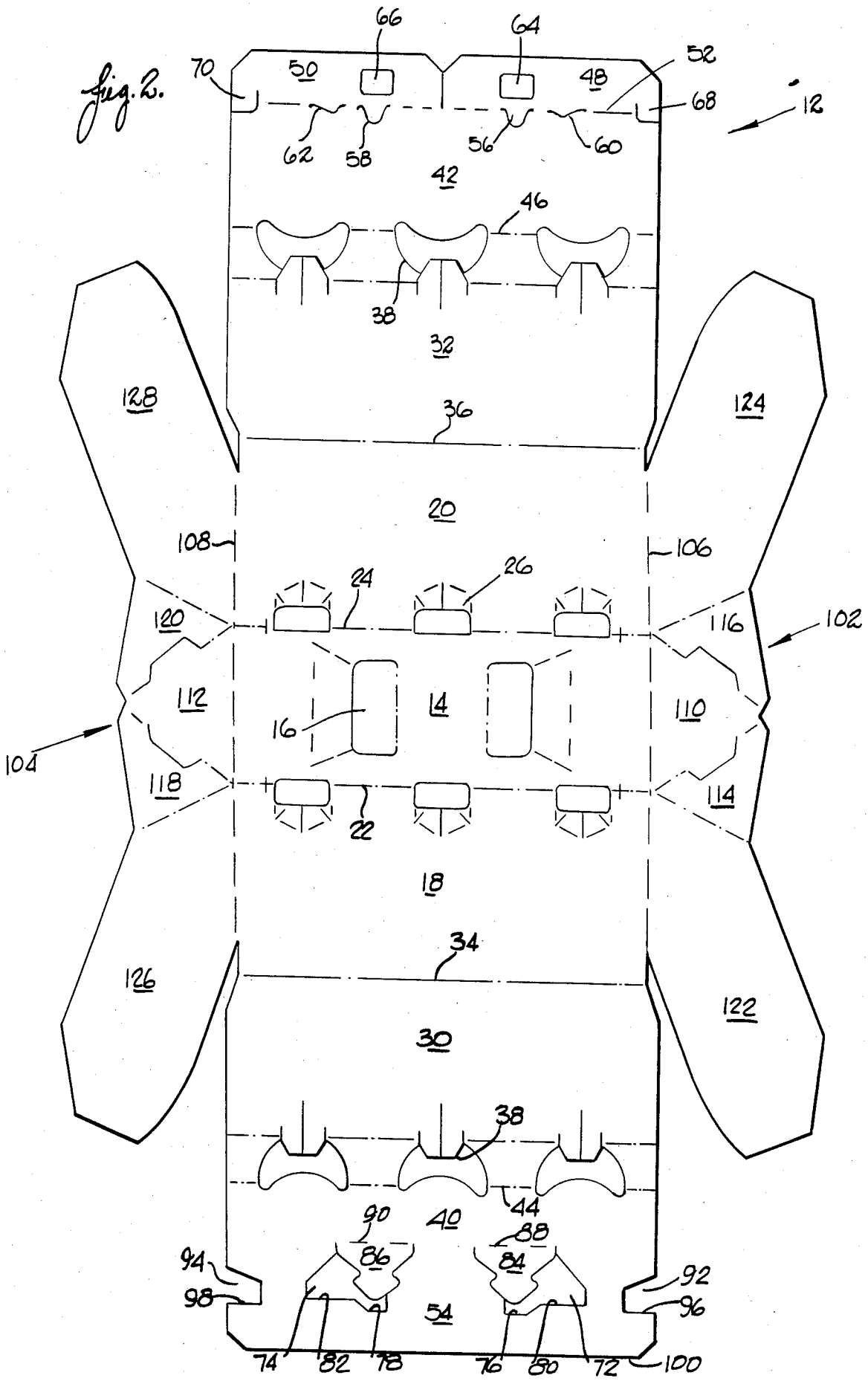
FIG. 2 is a plan view of a typical production blank employing the locking features of the present invention.

Referring to FIGS. 1 and 2 of the drawings, a typical beverage package 10, a wrap-around style beverage carrier, and a blank 12 used to form the package are shown. While the carrier illustrated is adapted to package bottles, the new locking features of the present invention can also be used on wrap-around carriers for packaging beverage cans as well as other types of bottles or cans.

The carrier 10 and blank 12 have a centrally located top panel 14 with a handle 16 thereon. The handle 16 comprises a pair of finger openings and tabs hingedly attached to the top panel.

A pair of sloping side panels 18 and 20 are hingedly attached to opposite sides of the top panel 14 along score lines 22 and 24. Each sloping side panel has formed therein a plurality of bottle neck receiving openings 26 for receiving the caps 28 of bottles contained within the package.

A pair of vertical side panels 30 and 32 are hingedly attached to the sloping side panels 18 and 20 along score lines 34 and 36. The vertical side panels 30 and 32 have a plurality of bottle bottom receiving openings 38 formed therein for receiving the bottoms of the bottles contained within the package.

A pair of bottom panels 40 and 42 are hingedly attached to the vertical side panels 30 and 32 along score lines 44 and 46. The bottom panel 42 has a first or outer margin comprising portions 48 and 50 which are hingedly attached to the bottom panel 42 along score line 52. The bottom panel 40 has a second or inner margin 54.

The first or outer margin 48 and 50 has primary male adjustable locking portions comprising oversized position tabs 56 and 58 and undersized position tabs 60 and 62. The first or outer margin also has secondary female punch-style locking openings 64 and 66 of a generally rectangular shape located between the primary locking tabs and the free edges of the margin 48 and 50. The first or outer margin is further provided with tertiary male locking tabs 68 and 70 defined by generally "L" shaped die cuts extending inward from the side edges of the margin 48 and 50.

The second or inner margin 54 has primary female locking portions comprising stepped slots 72 and 74. The stepped slots 72 and 74 have oversized position edges 76 and 78 and undersized position edges 80 and 82. The oversized position edges 76 and 78 are aligned with and positioned to be engaged by the oversized position tabs 56 and 58 when bottles sensed by the packaging machine as oversized are being packaged. The underside position edges 80 and 82 are aligned with and positioned to be engaged by the undersized position tabs 60 and 62 when bottles sensed by the packaging machine as undersized are being packaged.

The second or inner margin 54 is also provided with secondary punch-style male locking tabs 84 and 86 which are hingedly attached at their bases to the margin 54 along score lines 88 and 90. The punch-style locking tabs 84 and 86 have generally arrowhead shaped head portions and are positioned inward from the primary female locking portions 72 and 74 and in alignment with the secondary female punch-style locking openings 64 and 66 of the first or outer margin.

The second or inner margin 54 is further provided with tertiary female locking cutouts 92 and 94 which extend in from the side edges of the margin 54. The tertiary male locking tab engaging edges 96 and 98 of the cutouts, are longer than the widths of the tertiary male locking tabs 68 and 70, and extend substantially parallel to the oversized position edges 76 and 78, and the undersized position 80 and 82 of the primary locking slots. The spacing of the tertiary locking edges 96 and 98 from the free edge 100 of the margin 54 is greater than the spacing between margin edge 100 and the oversized position edges 76 and 78, and less than the spacing between margin edge 100 and the undersized position edges 80 and 82.

The production blank 12 and carrier 10 may also be formed with a pair of end panels 102 and 104 as illustrated in FIGS. 1 and 2. The end panels are hingedly attached to the top panel 14 and sloping side panels 18 and 20 along score lines 106 and 108 respectively. Each end panel comprises a central triangular panel 110 and 112, a pair of intermediate triangular panels 114, 116, and 118, 120, and a pair of vertical end panels 122, 124 and 126, 128. The intermediate triangular panels 114, 116 and 118, 120 are hingedly attached to the central panels and the vertical end panels along score lines as illustrated in FIG. 2.

Figure 7:
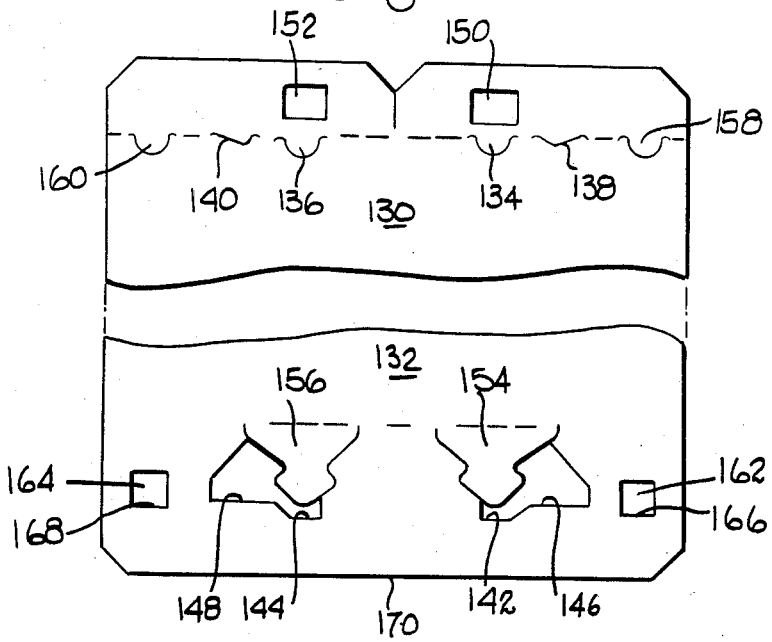
FIG. 7 is a partial view of the margins of a production blank similar to the production blank of FIG. 2, illustrating a second embodiment of the locking features of the present invention.

Referring now to FIG. 7 of the drawings, the bottom panels 130 and 132 of a second embodiment of the present invention are illustrated. The production blank and carrier of the second embodiment illustrated in FIG. 7 are the same as the production blank 12 and carrier 10 illustrated in FIGS. 1 and 2 with the exception of the locking features in the first or outer bottom panel 130 and the second or inner bottom panel 132.

The primary locking features: the oversized position tabs 134 and 136; the undersized position tabs 138 and 140; the slots with the oversized position edges 142 and 144; and the undersized position edges 146 and 148 are identical to those of the first embodiment as illustrated in FIGS. 1 to 6. The secondary locking features: the punch-style locking openings 150 and 152; and the punch-style locking tabs 154 and 156 are identical to those of the first embodiment as illustrated in FIGS. 1 to 6.

The tertiary locking features of the second embodiment differ from those of the first embodiment. The first or outer margin is provided with tertiary locking tabs 158 and 160 adjacent but spaced inwardly from the side edges of the outer margin. The second or inner margin is provided with tertiary locking openings 162 and 164 of generally rectangular shape. The tertiary locking openings 162 and 164 are aligned with the tertiary locking tabs 158 and 160 and are adjacent but spaced from the side edges of the inner margin. The tertiary locking openings 162 and 164 have male locking tab engaging edges 166 and 168 which are longer than the width of the tertiary male locking tabs 158 and 160, and extend substantially parallel to the oversized position edges 142 and 144, and the undersized position edges 146 and 148. The spacing of the tertiary locking edges 166 and 168 from the free edge 170 of the inner margin is greater than the spacing between the margin edge 170 and the oversized position edges 142 and 144, and less than the spacing between the margin edge 170 and the undersized position edges 146 and 148.

Figure 3:
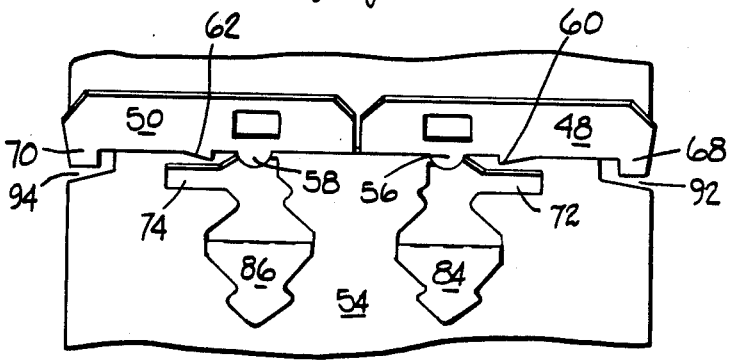
FIG. 3 is a partial view of the bottom panels of the package of FIG. 1 illustrating the initial engagement of the oversized position tabs with the oversized position slots and the tertiary locking tabs with the tertiary cutouts as the production blank of FIG. 2 is being locked about oversized bottles.
Figure 4:
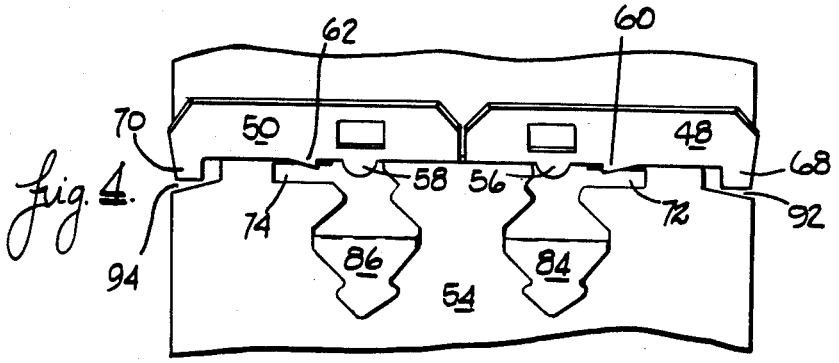
FIG. 4 is a partial view of the bottom panels of the package of FIG. 1 illustrating the initial engagement of the undersized position tabs with the undersized position slots and the tertiary locking tabs with the tertiary cutouts as the production blank of FIG. 2 is being locked about undersized bottles.

Referring to FIGS. 3 to 6 of the drawings, the locking sequence of the present invention is illustrated. FIG. 3 shows the oversized position tabs 56 and 58 engaging the oversized position edges 76 and 78 when a lot of bottles sensed by the packaging machine as oversized are being packaged. FIG. 4 shows the undersized position tabs 60 and 62 engaging the undersized position edges 80 and 82 when a lot of bottles sensed by the packaging machine as undersized are being packaged. At the same time the primary locks are being engaged, the tertiary locking tabs 68 and 70 are inserted into cutouts 92 and 94.

Figure 5:
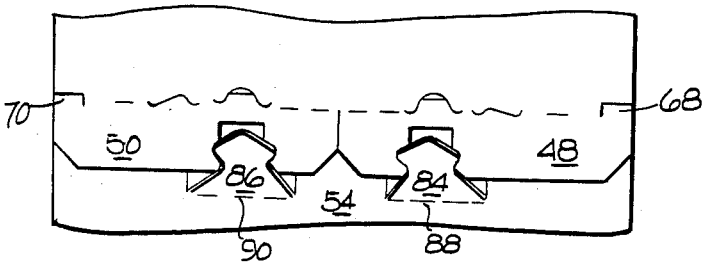
FIG. 5 is a partial view of the bottom panels of the package of FIG. 1 illustrating the locking sequence for oversized bottles wherein the first margin is folded down onto the second margin to lock the primary oversized position tabs in the oversized position slots, the tertiary locking tabs in the cutouts and to position the secondary punch-style locking openings for insertion of the punch-style locking tabs.
Figure 6:
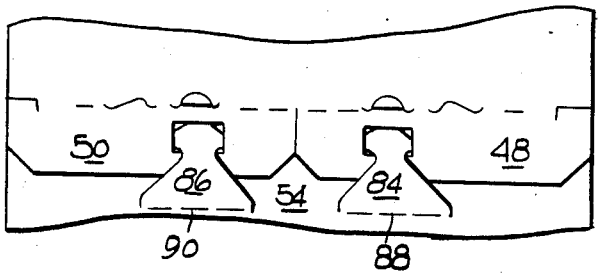
FIG. 6 is a partial view of the bottom panels of the package of FIG. 1 illustrating the package with the locking features completely locked when pacakaging oversized bottles.

Thereafter, the secondary punch-style locking tabs 84 and 86 are inserted into the secondary punch-style locking openings 64 and 66 as illustrated in FIGS. 5 and 6. FIG. 5 shows the punch-style locking tabs about to be inserted into the punch-style locking openings after the first or outer margin 48 and 50 has been folded down onto the inner margin 54 and the primary locking tabs are engaged in the primary locking slots and the tertiary locking tabs are engaged in the tertiary cutouts. FIG. 6 shows the punch-style locking tabs and openings fully locked.

In the first embodiment, the tertiary locking tabs 68 and 70 are engaged under the edges 96 and 98 of the tertiary cutouts 92 and 94 when the outer margin is folded down onto the inner margin as illustrated in FIGS. 5 and 6. While not shown the tertiary locking tabs 158 and 160 of the second embodiment of FIG. 7 are engaged under the edges 166 and 168 of the tertiary locking openings 162 and 164 in the same manner.

I claim:

1. A wrap-around style beverage package for a plurality of cans or bottles of beverage, the package surrounding the cans or bottles and having locking means on overlapping first and second margins of the package comprising:

the first margin having a primary male adjustable locking means comprising two oversized position tabs and two undersized position tabs;

the second margin having primary female adjustable locking means engaged by the primary male adjustable locking means of the first margin and comprising two oversized position slots positioned for engagement with the oversized position tabs on the first margin and two undersized position slots positioned for engagement with the undersized position tabs on the first margin;

the second margin having secondary punch-style male locking tabs;

the first margin having secondary punch-style female locking openings engaged by the secondary punch-style male locking tabs, the width of said male locking tabs being greater than the width of said openings;

the first margin having tertiary male locking tabs on each side of the primary male adjustable locking means;

the second margin having tertiary female openings on each side of the primary female adjustable locking means, said tertiary female openings being engaged by the tertiary male locking tabs, each of said tertiary female openings having a width equal to or greater than the width of the tertiary male locking tab engaged therein; and each tertiary female opening having an edge under which the associated tertiary male locking tab is engaged, each edge extending generally parallel to the free edge of the second margin and to edges of the two oversized position slots and the two undersized position slots of the primary female locking means which are positioned respectively for engagement with the two oversized position tabs and the two undersized position tabs of the primary locking means, with the spacing from the free edge of the second margin to the edges of the tertiary female openings being intermediate the spacing from the free edge of the second margin to the edges of the oversized position slots and the undersized position slots.

2. The beverage package as defined in claim 1 wherein said tertiary female openings are cutouts extending inwardly from the side edges of the second margin and the tertiary male locking tabs extend inwardly from the side edges of the first margin.

3. The beverage package as defined in claim 1 wherein said tertiary female openings are spaced from the side edges of the second margin and the tertiary male locking tabs are correspondingly spaced from the side edges of the first margin.

4. A production blank for a wrap-around style beverage carrier comprising:

a centrally positioned top panel having formed thereon handle means;

side panels hingedly attached to opposite sides of the top panel; and first and second bottom panels hingedly attached to the side panels;

the first bottom panel having a first outer margin with a free outer edge and the second bottom panel having a second outer margin with a free outer edge;

the first margin having a primary male adjustable locking means comprising two oversized position tabs and two undersized position tabs;

the second margin having a primary female adjustable locking means positioned for engagement by the primary male adjustable locking means of the first margin and comprising two oversized position slots positioned for engagement with the oversized position tabs on the first margin and two undersized position slots positioned for engagement with the undersized position tabs on the first margin;

the second margin having secondary punch-style male locking tabs and the first margin having secondary punch-style female locking openings positioned for engagement by the secondary punch-style male locking tabs, the width of the male locking tabs being greater than the width of the female locking openings;

the first margin having tertiary male locking tabs on each side of the primary male adjustable locking means, the second margin having tertiary female openings on each side of the primary female adjustable locking means positioned for engagement by the tertiary male locking tabs, each of said tertiary female openings having a width equal to or greater than the width of the tertiary male locking tab to be engaged therein; and each tertiary female opening having an edge under which the associated tertiary male locking tab is to be engaged, each edge extending generally parallel to the free edge of the second margin and to edges of the two oversized position slots and the two undersized position slots of the primary female locking means which are positioned respectively for engagement with the two oversized position tabs and the two undersized position tabs of the primary male locking means, with the spacing from the free edge of the second margin to the edges of the tertiary female openings being intermediate the spacing from the free edge of the second margin to the edges of the oversized position slots and the undersized position slots.

5. The production blank as defined in claim 4 wherein said tertiary female openings are cutouts extending inwardly from the side edges of the second margin and the tertiary male locking tabs extend inwardly from the side edge of the first margin.

6. The production blank as defined in claim 4 wherein said tertiary female openings are spaced inwardly from the side edges of the second margin and the tertiary male locking tabs are correspondingly spaced inwardly from the side edges of the first margin.

* * * * *